US008398215B2

(12) United States Patent
Takamoto

(10) Patent No.: US 8,398,215 B2
(45) Date of Patent: Mar. 19, 2013

(54) LIQUID EJECTING HEAD WITH A COMMON LIQUID CHAMBER

(75) Inventor: Tetsuya Takamoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 147 days.

(21) Appl. No.: 12/975,673

(22) Filed: Dec. 22, 2010

(65) Prior Publication Data

US 2011/0164091 A1 Jul. 7, 2011

(30) Foreign Application Priority Data

Jan. 6, 2010 (JP) ..... 2010-001074

(51) Int. Cl.
*B41J 2/045* (2006.01)

(52) U.S. Cl. ..... 347/68; 347/65; 347/70

(58) Field of Classification Search ..... 347/20, 347/63, 65, 68, 70, 71
See application file for complete search history.

(56) References Cited

U.S. PATENT DOCUMENTS 4,611,219 A * 9/1986 Sugitani et al. ..... 347/68
6,695,442 B2 2/2004 Kitahara

FOREIGN PATENT DOCUMENTS

JP 2003-063010 3/2003

* cited by examiner

*Primary Examiner* — Juanita D Jackson
(74) *Attorney, Agent, or Firm* — Workman Nydegger

(57) ABSTRACT

An intermediate liquid chamber is formed between an ink conducting path to which ink is supplied from an ink supply source such as an ink cartridge and a common liquid chamber to which ink to be provided to a plurality of pressure chambers is supplied. The intermediate liquid chamber communicates with both the ink conducting path and the common liquid chamber. The intermediate liquid chamber includes a conducting opening which communicates with the ink conducting path and a discharge opening which is opened to the common liquid chamber. The discharge opening is formed from one edge portion to the other edge portion of the common liquid chamber along a pressure chamber arrangement direction.

9 Claims, 4 Drawing Sheets

LIQUID EJECTING HEAD WITH A COMMON LIQUID CHAMBER

BACKGROUND

1. Technical Field

The present invention relates to a liquid ejecting head such as an ink jet recording head and a liquid ejecting apparatus equipped with the liquid ejecting head, particularly to a liquid ejecting head including a liquid passage through a liquid conducting path, a common liquid chamber, an individual supply path, and a pressure chamber, to a nozzle, and a liquid ejecting apparatus equipped therewith.

2. Related Art

A liquid ejecting apparatus is an apparatus that includes a liquid ejecting head capable of ejecting liquid as a liquid droplet and ejects various kinds of liquid from the liquid ejecting head. Image recording apparatuses such as ink jet recording apparatuses (printers) which include an ink jet recording head (hereinafter, referred to as a recording head) and perform recording by ejecting liquid ink as an ink droplet from the recording head, are typical examples of the liquid ejecting apparatus. Recently, the liquid ejecting head has been used not only for such image recording apparatuses but also for manufacturing a color filter of a liquid crystal display panel, an organic EL element, a thin-film transistor, or the like.

The recording head, a type of the liquid ejecting head, includes a nozzle group (nozzle row) formed of a plurality of nozzles for each type of ink (color or the like), and each nozzle communicates with its corresponding pressure chamber. The recording head further includes a common liquid chamber (also called a reservoir or manifold) to which ink to be distributed to a plurality of pressure chambers is supplied. The common liquid chamber extends in a direction of the pressure chambers being arranged when viewed from above and has a space with a predetermined width (width in a direction perpendicular to the pressure chamber arrangement direction) and depth. In a typical common liquid chamber, a conducting opening which serves as a connection port to the liquid conducting path is positioned at the central portion in the pressure chamber arrangement direction. The ink from a liquid supply source such as an ink cartridge is supplied to the common liquid chamber through the liquid conducting path, from which the ink is distributed to each pressure chamber through the individual supply path. Then, a pressure generation unit such as a piezoelectric device is driven so as to generate pressure fluctuation in the ink in the pressure chamber. This pressure fluctuation causes the ink to be ejected from the nozzle (see JP-A-2003-063010, for example).

The recording head including the aforementioned common liquid chamber has a risk that when air bubbles come into a passage of ink, the air bubbles may cause instability of ink ejection such as a decrease in ejection speed and quantity of the ink ejected from the nozzle, and the like because those air bubbles absorb the pressure fluctuation at the time of ink ejection. Therefore, the structure of the liquid conducting path and the shape of the common liquid chamber are taken into consideration in designing the recording head so as to exclude air bubbles effectively. For example, with regard to a planar shape of the common liquid chamber, either edge of the chamber is tapered, i.e., the width of the chamber in a direction perpendicular to the pressure chamber arrangement direction is gradually reduced toward the edge in the pressure chamber arrangement direction of the common liquid chamber so that the air bubbles do not stagnate at either edge portion of the common liquid chamber.

FIG. 6 is a plan view illustrating an example of a configuration of a common liquid chamber and its surroundings in related art. In the common liquid chamber in the related art, ink supplied from a conducting opening 52 flows toward an edge portion in the pressure chamber arrangement direction as indicated by streamlines A and B. Such configuration in the related art has the following problems. That is, in a common liquid chamber 51, for example, in the case where an air bubble X covers an individual supply path 54 which communicates with a pressure chamber 53, there exists a risk that the ink ejection from a nozzle 55 corresponding to the pressure chamber 53 becomes unstable. Further, if the air bubble X flows along the ink streamline A from the conducting opening 52 toward the edge of the common liquid chamber 51 and moves to an individual supply path communicating with another pressure chamber, the ink ejection from a nozzle corresponding to this pressure chamber will become unstable. That is, there exists a problem in which the instability of ink ejection propagates with the movement of the air bubble. In addition, there exists another risk that ink ejection at a pressure chamber located in a position far from the conducting opening 52, i.e., a pressure chamber located in the edge portion in the pressure chamber arrangement direction, becomes unstable in comparison with that at a pressure chamber near the conducting opening 52 due to a pressure loss which is generated during the process of flowing from the conducting opening.

SUMMARY

An advantage of some aspects of the invention is to provide a liquid ejecting head having improved liquid ejection characteristics with a configuration in which the liquid is provided from a common liquid chamber to a plurality of pressure chambers, and a liquid ejecting apparatus with the liquid ejecting head.

According to an aspect of the invention, there is provided a liquid ejecting head including a liquid passage having a liquid conducting path, a common liquid chamber, a plurality of individual supply paths, a plurality of pressure chambers, and nozzles. Liquid from a liquid supply source is supplied to the common liquid chamber through the liquid conducting path, the liquid in the common liquid chamber is distributed to each of the plurality of pressure chambers through each of the individual supply paths, pressure fluctuation is caused in the liquid in the pressure chamber by driving a pressure generation unit, and the liquid is ejected from the nozzles. The liquid passage includes an intermediate liquid chamber that is provided between the liquid conducting path and the common liquid chamber and communicates with the liquid conducting path and the common liquid chamber. The intermediate liquid chamber has a conducting opening which communicates with the liquid conducting path and a discharge opening which is opened to the common liquid chamber. The discharge opening is formed along the pressure chamber arrangement direction.

It is preferable that the configuration of the liquid ejecting head be a configuration in which a pressure loss in the discharge opening is larger than that generated in a flow path from the conducting opening to the edge portion of the intermediate liquid chamber in the pressure chamber arrangement direction.

In the liquid ejecting head according to the aspect of the invention, the intermediate liquid chamber is disposed between the liquid conducting path and common liquid chamber. The intermediate liquid chamber has a conducting opening and a discharge opening. The discharge opening is formed along the pressure chamber arrangement direction. Accordingly, the liquid supplied from the intermediate liquid chamber to the common liquid chamber via the discharge opening is made to flow toward each of the individual supply paths more in parallel to a direction perpendicular to the pressure chamber arrangement direction (pressure chamber lengthwise direction) in comparison with the flow of liquid in the configuration in the related art in which no intermediate chamber is provided. As a result, a liquid flow in the pressure chamber arrangement direction hardly takes place in the common liquid chamber. Therefore, even if an air bubble comes into the common liquid chamber, movement of the air bubble along the individual supply paths with the liquid flow is suppressed and the propagation of unstable liquid ejection along the nozzles is prevented. Further, since the liquid is supplied to each of the individual supply paths at a more equalized flow speed, a problem is prevented in which quantity and ejection speed of the liquid ejected from a nozzle corresponding to a pressure chamber located in the edge portion in the pressure chamber arrangement direction will decrease in comparison with those of the liquid ejected from a nozzle located at the center portion. Therefore, the configuration according to the aspect of the invention makes it possible to improve the characteristics of liquid ejection at each nozzle.

In the above configuration, it is possible to employ a configuration in which a pressure loss at the edge portion of the discharge opening in the pressure chamber arrangement direction is smaller than that at the center portion of the discharge opening in the pressure chamber arrangement direction.

With this configuration, since the pressure loss at the edge portion of the discharge opening in the pressure chamber arrangement direction is made smaller than that at the center portion of the discharge opening in the pressure chamber arrangement direction, it is more surely suppressed that pressure of liquid supply at the edge portion, which is far from the conducting opening in the pressure chamber arrangement direction, becomes lower than that at the center portion. As a result, the characteristics of liquid ejection such as quantity and ejection speed of the liquid to be ejected from a nozzle corresponding to a pressure chamber located at the edge portion in the pressure chamber arrangement direction, are prevented from being lowered with certainty.

Meanwhile, in each of the above configurations, it is preferable that a configuration be employed in which an edge surface of the common liquid chamber in the pressure chamber arrangement direction and an edge surface of the intermediate liquid chamber in the pressure chamber arrangement direction are flush.

Further in each of the above configurations, it is preferable that a configuration be employed in which the edge surface of the common liquid chamber in the pressure chamber arrangement direction is in parallel to the individual supply paths.

With this configuration, since both edge surfaces of the common liquid chamber in the pressure chamber arrangement direction are in parallel to the individual supply paths, the flow of liquid in both edge portions of the common liquid chamber in the pressure chamber arrangement direction is made to be more in parallel to the individual supply paths in comparison with the flow of liquid in the configuration in the related art in which the shape of both edge portions of the common liquid chamber in the pressure chamber arrangement direction is tapered down.

Further in the configuration, it is preferable that a bottom of the discharge opening and a bottom of each of the individual supply paths be flush.

With this configuration, as the bottom surface of the discharge opening and the bottom surface of each of the individual supply paths are flush, the formation of the discharge opening by etching can be carried out along with the formation of the individual supply paths at the same time.

In the configuration, a configuration may be adopted in which the discharge opening is formed into a slit-like shape from one edge to the other edge of the common liquid chamber along the pressure chamber arrangement direction.

The discharge opening may adopt a configuration in which the opening is formed of a plurality of apertures corresponding to the plurality of pressure chambers along the pressure chamber arrangement direction.

The liquid ejecting apparatus according to another aspect of the invention includes one of the configurations of the liquid ejecting head mentioned above.

According to the invention, the liquid supplied from the intermediate liquid chamber to the common liquid chamber via the discharge opening is made to flow toward each of the individual supply paths more in parallel to a direction perpendicular to the pressure chamber arrangement direction in comparison with the flow of liquid in the configuration in the related art in which no intermediate chamber is provided. As a result, a liquid flow in the pressure chamber arrangement direction hardly takes place in the common liquid chamber. Therefore, even if an air bubble comes into the common liquid chamber, movement of the air bubble along the individual supply paths with the liquid flow is suppressed and the propagation of unstable liquid ejection along the nozzles is prevented. Further, since the liquid is supplied to each of the individual supply paths at a more equalized flow speed, a problem is prevented in which quantity and ejection speed of the liquid ejected from a nozzle corresponding to a pressure chamber located in the edge portion in the pressure chamber arrangement direction decrease in comparison with those of the liquid ejected from a nozzle located in the center portion. Therefore, the configuration according to the invention makes it possible to improve the characteristics of liquid ejection at each nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the appended drawings. Although various limitations are made in the embodiments described hereinafter in order to illustrate a specific preferred example of the invention, it should be noted that the scope of the invention is not intended to be limited to this embodiments unless otherwise mentioned. An ink jet recording apparatus (referred to as a "printer") will be given hereinafter as an example of a liquid ejecting apparatus according to the invention.

Figure 1:
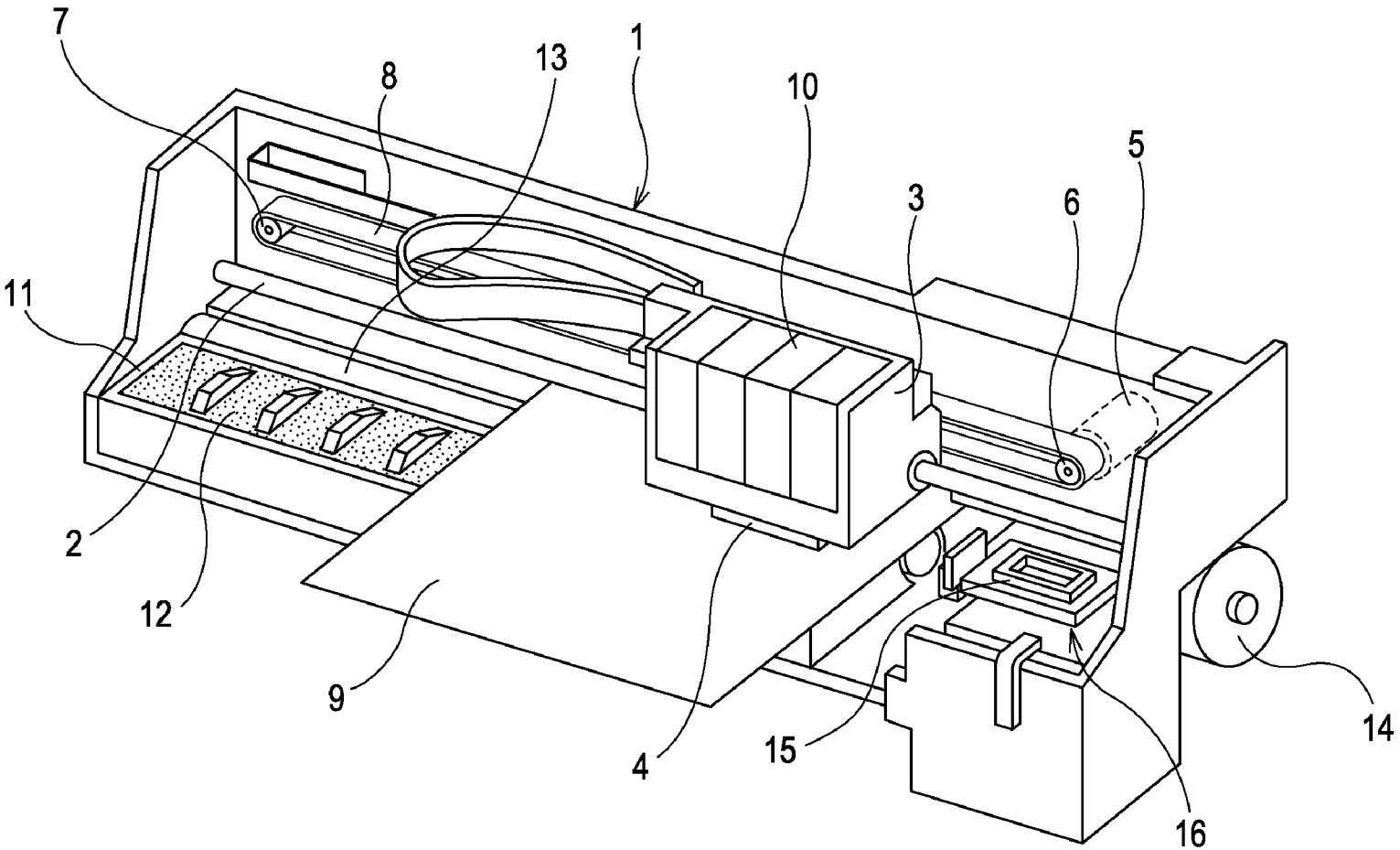
FIG. 1 is a perspective view illustrating a configuration of a printer.

FIG. 1 is a perspective view illustrating a basic configuration of a printer 1. As shown in FIG. 1, the printer 1 includes a carriage 3 attached to a guide shaft 2. A recording head 4 (an example of the liquid ejecting head according to the invention) is attached to the lower surface of the carriage 3. An ink cartridge 10 (an example of a liquid supply source) is detachably held in the carriage 3. Further, the carriage 3 is connected to a timing belt 8 that is stretched upon between a driving pulley 6 and a slave pulley 7. The driving pulley 6 is joined to a rotational shaft of a carriage motor 5. Then, the carriage 3 moves in a width direction of a recording sheet 9 (main scanning direction), which is driven by rotation of the carriage motor 5. That is, a carriage movement mechanism is configured of the carriage motor 5, the driving pulley 6, the slave pulley 7, and the timing belt 8.

The ink cartridge 10 is a storage member that stores ink (an example of the liquid of the invention). The ink is made by dissolving or dispersing color material in an ink solvent. For example, a pigment or a colorant is used as a color material, while water is used as an ink solvent. When the ink cartridge 10 is mounted in the carriage 3, an ink supply needle (not shown) of the recording head 4 is inserted into the ink cartridge 10. Since the ink supply needle communicates with an ink passage (an example of a liquid passage) in the recording head 4, the ink stored in the ink cartridge 10 becomes ready for being supplied to the recording head 4 when the ink needle is inserted. It is also possible to adopt an example of an ink cartridge which is arranged in the printer main body (housing) and supplies ink to the recording head 4 through an ink supply tube.

A platen 11 is provided below the guide shaft 2. The platen 11 is a plate member that supports the recording sheet 9 from the lower side. A liquid absorbing member 12 such as a sponge is disposed on the platen 11. A paper feed roller 13 is disposed in parallel to the guide shaft 2 on the upstream side of the liquid absorbing member 12 in a paper feed direction. The paper feed roller 13 rotates with driving force of a paper feed motor 14 (stepping motor or DC motor) when transporting the recording sheet 9. That is, the paper feed mechanism includes the paper feed roller 13 and the paper feed motor 14.

A home position is set at a position which is outside of the platen 11 and within the movement range of the carriage 3. The recording head 4 is placed in the home position in a standby state. In the home position, a wiper mechanism 15 to wipe off a nozzle forming-face in the recording head 4 and a capping mechanism 16 capable of sealing the nozzle forming-face in a non-recording state are provided abreast along the guide shaft 2.

Figure 2:
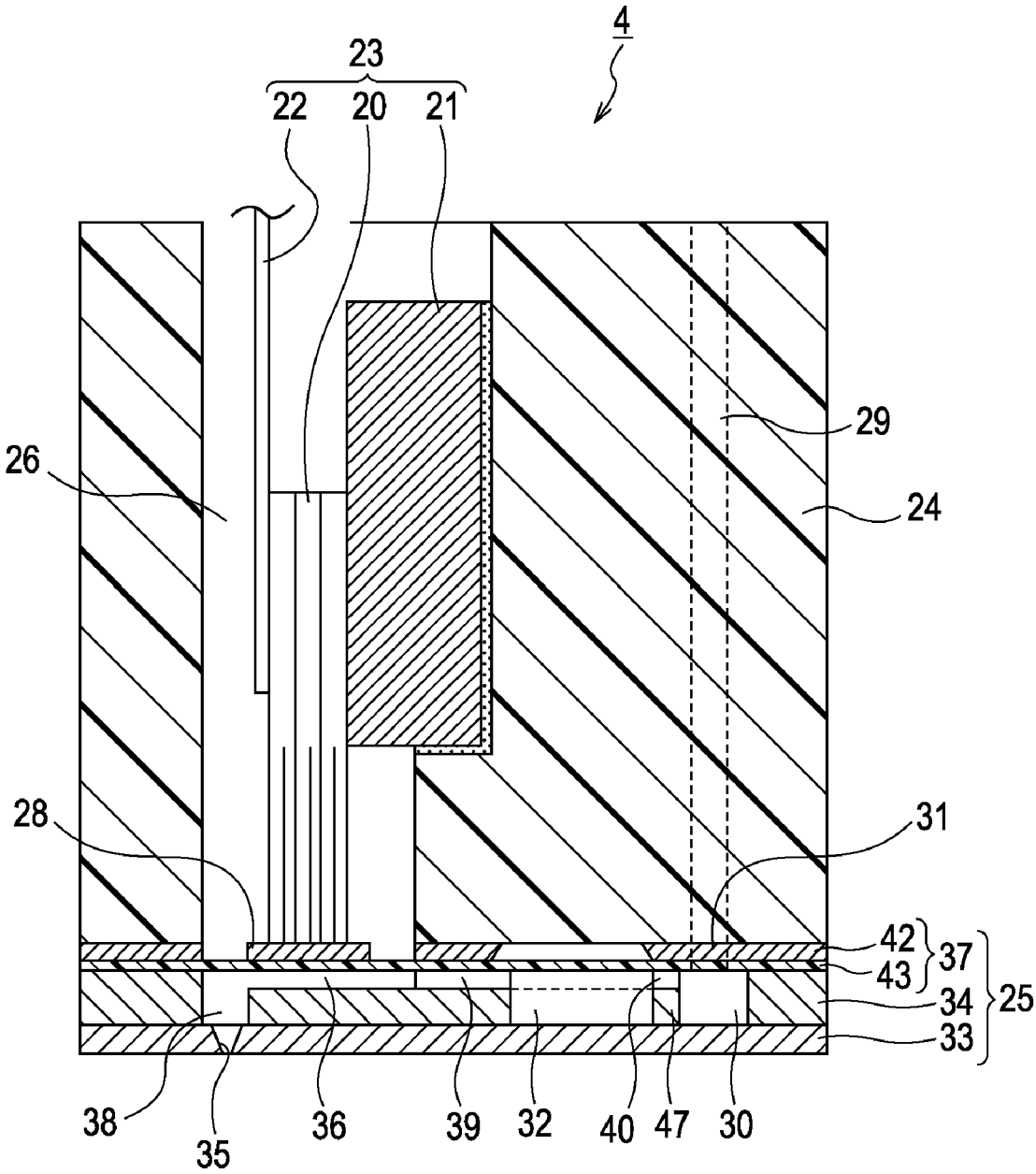
FIG. 2 is a cross-sectional view illustrating a main portion of a recording head.

FIG. 2 is a cross-sectional view illustrating a configuration of the main portion of the recording head 4. The exemplified recording head 4 includes an actuator unit 23 which unitizes a plurality of piezoelectric devices 20, a fixed plate 21, a flexible cable 22 and the like; a casing 24 capable of accommodating the actuator unit 23; and a passage unit 25 joined to the bottom of the casing 24.

The casing 24 is a block-shaped member made of a synthetic resin in which an accommodation space 26 is formed. The accommodation space 26 is a space to accommodate the actuator unit 23. The fixed plate 21 is bonded to an inner wall surface of the accommodation space 26 so that the actuator unit 23 is fixedly accommodated in the accommodation space 26. In this accommodation state, an edge surface of a free end portion of the piezoelectric device 20 faces a bottom-side opening of the accommodation space 26 and is joined to an island portion 28 in the passage unit 25. Further in the casing 24, an ink conducting path 29 (an example of a liquid conducting path) that communicates with an intermediate liquid chamber 30 (explained later) in the passage unit 25 is provided penetratingly through the casing 24 from the upper surface side in a height direction of the casing 24. The upstream side of the ink conducting path 29 communicates with the ink supply needle (not shown) and the downstream side thereof communicates with the intermediate liquid chamber 30 in the passage unit 25 via the conducting opening 31. Thus, the ink supplied from a liquid supply source such as the ink cartridge 10 via the ink supply needle is supplied to the common liquid chamber 32 through the intermediate liquid chamber 30.

The piezoelectric device 20 in the actuator unit 23 is formed in a comb-toothed fashion and cut into multiple sections each of which having a width of tens of micrometers to approximately a hundred micrometers. Further, each piezoelectric device 20 protrudes its free end portion to the outer side of an edge surface of the fixed plate 21 (edge surface on the side of the passage unit 25 in a state where the fixed plate 21 is bonded to the casing 24) in a so-called cantilever beam state, in which a base end portion of the piezoelectric device is secured to the fixed plate 21. The piezoelectric device 20 is a device having a multilayer structure in which piezoelectric bodies and internal electrodes are alternately layered, and is capable of expansion and contraction in a longitudinal direction which is perpendicular to an electric field direction (lengthwise direction of the piezoelectric device). Therefore, when the piezoelectric device 20 is charged, the free end portion thereof contracts in the lengthwise direction of a vibrator, while the free end portion expands in the lengthwise direction of the vibrator when the device is discharged. The flexible cable 22 is electrically connected to the base end portion of each piezoelectric device 20.

The passage unit 25 is configured such that a nozzle substrate 33 is disposed on one surface of a passage substrate 34 and a vibration plate 37 is disposed on the other surface of the passage substrate 34 opposite the nozzle substrate 33, then the nozzle substrate 33, passage substrate 34 and vibration plate 37 are formed as one unit by adhesive or the like. The nozzle substrate 33 is a thin film made of stainless steel or an organic plastic film. A plurality of nozzles 35 are arranged in a row at a pitch according to a dot-forming density, in the nozzle substrate 33. In the embodiment, for example, 180 nozzles 35 are opened at a pitch for 180 dpi, and these nozzles configure a nozzle row (an example of a nozzle group). The passage substrate 34 is a member which is made of a single crystal silicon substrate, and a plurality of openings to be the pressure chambers 36 corresponding to the nozzles 35 are formed in the passage substrate 34 in a state in which the passage substrate 34 is divided with a partition wall. Further in the passage substrate 34 according to the embodiment, in addition to the openings to be the pressure chambers 36, the following openings are formed by etching: openings for the individual supply paths 39 provided for respective pressure chambers, an opening for the common liquid chamber 32 communicating with the pressure chambers 36 via the individual supply paths 39, and an opening for the intermediate liquid chamber 30 which is disposed between the conducting opening 31 communicating with the ink conducting path 29 and the common liquid chamber 32. Note that the pressure chambers 36, individual supply paths 39, common liquid chamber 32 and intermediate liquid chamber 30 may be formed of different material members from each other.

The pressure chambers 36 are long and thin openings in a direction perpendicular to an arrangement direction of the nozzles 35, and are formed by etching from the upper surface of the passage substrate 34 (surface to which the vibration plate 37 is joined) to the halfway in the plate-thickness direction. In an edge portion in the lengthwise direction of each pressure chamber 36 (perpendicular to the pressure chamber arrangement direction), a nozzle communication opening 38 which penetrates through in the plate-thickness direction is provided. The nozzle communication opening 38 is formed penetratingly through the passage substrate 34 in the plate-thickness direction and communicates between the corresponding pressure chamber 36 and nozzle 35. Each supply path 39 is a ditched area formed between the other edge portion in the lengthwise direction of each pressure chamber 36 and the common liquid chamber 32, and its depth is arranged to be the same as that of the pressure chamber 36 while its passage width is sufficiently smaller than the width of the pressure chamber 36.

The vibration plate 37 is a double-layered structure member in which an elastic membrane 43 made of a resin film such as PPS (polyphenylene sulfide) is laminated on a support plane 42 made of stainless steel or the like, and has a diaphragm portion that seals one of aperture planes of the pressure chambers 36 and a compliance portion that seals one of aperture planes of the common liquid chamber 32. The diaphragm portion is manufactured by etching a part of the support plate 42 locationally corresponding to the pressure chambers 36 in a circular fashion, and forms an island portion 28 within the circled part. On the other hand, the compliance portion is manufactured by etching to remove a part of the support plate 42 locationally corresponding to the common liquid chamber 32 such that only the elastic membrane 43 remains.

In the above configuration of the recording head 4, the piezoelectric device 20 expands in the vibrator lengthwise direction and presses the island 28 toward the nozzle substrate 33, causing the elastic membrane 43 forming the diaphragm portion to deform and contract the pressure chambers 36. On the other hand, when the piezoelectric device 20 contracts in the vibrator lengthwise direction, the pressure chambers 36 are caused to expand due to the elasticity of the elastic membrane 43. Since the pressure of the ink in the pressure chambers 36 fluctuates due to expansion and contraction of the pressure chambers 36, an ink droplet (an example of a liquid droplet) can be ejected from the nozzles 35 by controlling the expansion and contraction of the chambers.

Next, features of the recording head 4 according to the invention will be described.

Figure 3A:
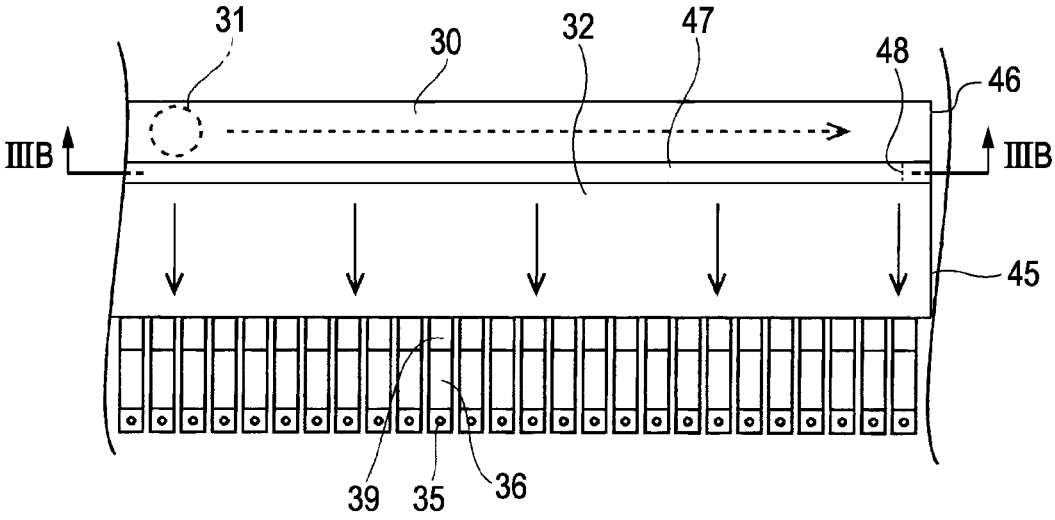
FIGS. 3A and 3B are views illustrating a configuration of a common liquid chamber and its surroundings.
Figure 3B:
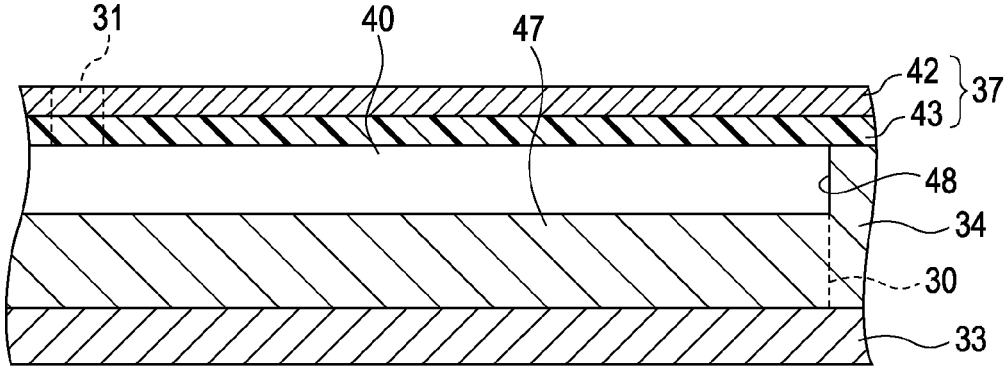

FIGS. 3A and 3B are views illustrating a configuration of an ink passage from the conducting opening 31 to the nozzles 35. FIG. 3A is a plan view of the main portion of the passage substrate 34, and FIG. 3B is a cross-sectional view taken along the line IIIB-IIIB in FIG. 3A. Note that FIGS. 3A and 3B illustrate approximately the right half of the whole configuration when viewed from the conducting opening 31 which is located at the center portion in the pressure chamber arrangement direction. The left half and the right half together form a symmetric configuration. The left half is a half on one edge portion and the right half is a half on the other edge portion in the pressure chamber arrangement direction. A feature of the recording head 4 according to the invention is that the intermediate liquid chamber 30 is disposed between the conducting opening 31 which is a connection port to the ink conducting path 29 and the common liquid chamber 32.

Explanation of the common liquid chamber 32 will be given first. The common liquid chamber 32 according to the embodiment is a rectangular opening when seen from above extending in the pressure chamber arrangement direction, is formed penetratingly through the passage substrate 34, and communicates with each pressure chamber 36 via the individual supply path 39. An aperture portion in the upper surface of the common liquid chamber 32 (surface on the vibration plate 37 side) is sealed with the elastic membrane 43 of the vibration plate 37 which is joined to the passage substrate 34. This sealed portion is the compliance portion (see FIG. 2). An aperture portion in the lower surface, opposite the upper surface, is sealed with the nozzle substrate 33 which is joined to the passage substrate 34. That is to say, the nozzle substrate 33 also serves as the bottom portion of the common liquid chamber 32. Both edge surfaces (both side surfaces) 45 of the common liquid chamber 32 in the pressure chamber arrangement direction are located slightly outside of the individual supply paths 39 arranged at both the edge portions in the pressure chamber arrangement direction. Both the edge surfaces 45 are planes which are in parallel to a direction perpendicular to the pressure chamber arrangement direction (lengthwise direction of the pressure chambers 36), i.e., in parallel to sidewalls of passage of the individual supply paths 39. Further, while one edge of each supply path 39 communicates with the corresponding pressure chamber 36, the other edge thereof is opened to a surface of the common liquid chamber 32 on the pressure chamber 36 side.

The intermediate liquid chamber 30, like the common liquid chamber 32, is a rectangular space when seen from above, extends in the pressure chamber arrangement direction, and is formed penetratingly through the passage substrate 34. An aperture portion in the upper surface of the intermediate liquid chamber 30 is sealed with the elastic membrane 43 and support plate 42 of the vibration plate 37 which is joined to the passage substrate 34 (see FIG. 2). The conducting opening 31 is arranged in a portion of the vibration plate 37 locationally corresponding to the intermediate liquid chamber 30. The ink conducting path 29 in the casing 24 is connected to the conducting opening 31 in a liquid-tight manner. Although the conducting opening 31 is provided in the vibration plate 37, it can also be said that the intermediate chamber 30 includes the conducting opening 31 because the conducting opening 31 is provided in a partitioned portion that defines the intermediate liquid chamber 30. An aperture portion in the lower surface of the intermediate liquid chamber 30 is sealed with the nozzle substrate 33 joined to the passage substrate 34. The length of the intermediate chamber 30 in the pressure chamber arrangement direction is arranged to be the same as that of the common liquid chamber 32 in the pressure chamber arrangement direction. Accordingly, both edge surfaces 46 of the intermediate liquid chamber 30 in the pressure chamber arrangement direction and both the edge surfaces 45 of the common liquid chamber 32 are flush. On the other hand, the width of the intermediate liquid chamber 30 in a direction perpendicular to the pressure chamber arrangement direction is sufficiently smaller than that of the common liquid chamber 32, whereby the volume of the intermediate liquid chamber 30 is smaller than that of the common liquid chamber 32. It may be possible to employ a configuration in which the intermediate liquid chamber 30 is formed not penetratingly, but halfway the passage substrate 34 in the plate-thickness direction thereof.

The intermediate liquid chamber 30 and common liquid chamber 32 are separated by a partition wall 47. As shown in FIG. 3B, a discharge opening 40 which is formed into a slit-like shape along the pressure chamber arrangement direction from one edge portion to the other edge portion of the common liquid chamber 32, is provided on the partition wall 47. The discharge opening 40 is formed by etching to partly remove the passage substrate 34 from the upper surface (vibration plate 37 side) downward to a desired point in the plate-thickness direction of the passage substrate 34. Both edge surfaces (both side surfaces) 48 of the discharge opening 40 in the pressure chamber arrangement direction, both the edge surfaces 45 of the common liquid chamber 32 and both the edge surfaces 46 of the intermediate liquid chamber 30, are flush. The bottom surface of the discharge opening 40 and the bottom surface of passage of the individual supply paths 39 are flush. Accordingly, the formation of the discharge opening 40 by etching can be carried out simultaneously with the formation of the pressure chambers 36 and the individual supply paths 39. The discharge opening 40 generates a passage resistance to ink that flows from the intermediate chamber 30 to the common liquid chamber 32. Dimensions (or cross-sectional area) of the discharge opening 40 are determined so that the pressure loss in the discharge opening 40 becomes larger than that in the flow path from the conducting opening 31 to the edge portions of the intermediate liquid chamber 30 in the pressure chamber arrangement direction (indicated by the broken-line arrow in FIG. 3A).

In the recording head 4 with the above configuration, ink is supplied from the ink supply needle to go down through the ink conducting path 29. Then, the ink flows into the intermediate liquid chamber 30 via the conducting opening 31; thereafter the ink is supplied to the common liquid chamber 32 via the discharge opening 40. As explained above, the pressure loss in the discharge opening 40 is set to become large. Therefore, the ink that has flowed into the intermediate liquid chamber 30 through the conducting opening 31, is supplied (discharged) from the discharge opening 40 to the common liquid chamber 32 at substantially an equally raised pressure regardless of the distance from the conducting opening 31 in the intermediate liquid chamber 30. Accordingly, the ink that has flowed into the common liquid chamber 32 from the discharge opening 40 flows toward each of the individual supply paths 39 more in parallel to a direction perpendicular to the pressure chamber arrangement direction (lengthwise direction of the pressure chambers 36) as indicated by the solid arrows in FIG. 3A in comparison with the flow of ink in the configuration in the related art in which no intermediate chamber 30 is included. As a result, an ink flow in the pressure chamber arrangement direction hardly takes place in the common liquid chamber 32. Therefore, even if an air bubble comes into the common liquid chamber 32, movement of the air bubble in the pressure chamber arrangement direction between the individual supply paths 39 with the ink flow is suppressed and the propagation of unstable liquid ejection along the nozzles 35 is prevented.

Further, since ink is supplied to each of the individual supply paths 39 at a more equalized flow speed, a problem is prevented such that quantity and ejection speed of the ink ejected from a nozzles 35 corresponding to pressure chambers 36 located in the edge portions in the pressure chamber arrangement direction decrease in comparison with those of the ink ejected from a nozzle 35 located at the center portion. Therefore, according to the invention, it is possible to improve the characteristics of liquid ejection at each nozzle.

In addition, as the pressure of ink can be made to be close to an even value in the intermediate liquid chamber 30 regardless of the distance from the conducting opening 31, the position of the conducting opening 31 is not limited to the center portion of the intermediate liquid chamber 30 in the pressure chamber arrangement direction, whereby the degree of freedom in determining the location of the conducting opening 31 increases and consequently the degree of freedom in determining the location of the ink conducting path 29 increases.

In the embodiment, since both the edge surfaces 45 of the common liquid chamber 32 are in parallel to a direction perpendicular to the pressure chamber arrangement direction, i.e., in parallel to passages of the individual supply paths 39, the flow of ink in both the edge portions of the common liquid chamber 32 in the pressure chamber arrangement direction becomes to be more in parallel to the direction perpendicular to the pressure chamber arrangement direction in comparison with the flow of ink in the configuration in the related art in which the shape of both edge portions in the pressure chamber arrangement direction is tapered down.

Next, other embodiments according to the invention will be described.

Figure 4:
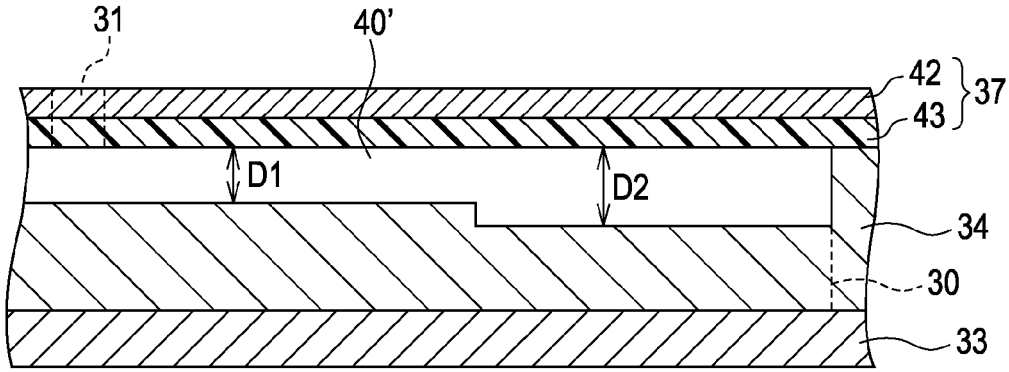
FIG. 4 is a cross-sectional view illustrating a configuration according to a second embodiment of the invention.

FIG. 4 is a cross-sectional view illustrating a discharge opening 40' in a configuration according to a second embodiment. In the embodiment, what is different from the first embodiment is that a slit width of the discharge opening 40' varies in accordance with a distance from the conducting opening 31. Since the other portions in the configuration are the same as in the first embodiment, description of the other portions will be omitted. As shown in FIG. 4, the discharge opening 40' is formed such that a slit width D2 of the edge side portion which is far from the conducting opening 31 is larger than a slit width D1 of the center portion which is relatively close to the conducting opening 31. Accordingly, the pressure loss at the edge portion of the discharge opening 40' in the pressure chamber arrangement direction becomes smaller than that at the center portion of the discharge opening 40' in the pressure chamber arrangement direction. Therefore, it is more surely suppressed that the pressure of ink supply at the edge portion, which is far from the conducting opening 40' in the pressure chamber arrangement direction, becomes lower than that at the center portion. As a result, the characteristics of ink ejection, such as quantity and ejection speed of the ink ejected from the nozzles 35 corresponding to the pressure chambers 36 located at the edge portions in the pressure chamber arrangement direction, are prevented with certainty from being deteriorated. Although an example in which the slit width of the discharge opening 40' changes in two steps is illustrated in FIG. 4, the slit width of the discharge opening 40' is not limited to the example of FIG. 4. The slit width may change in multiple steps such as three or more in a way such that the width becomes larger stepwise from the center portion of the discharge opening 40' toward the edge portion thereof.

Figure 5:
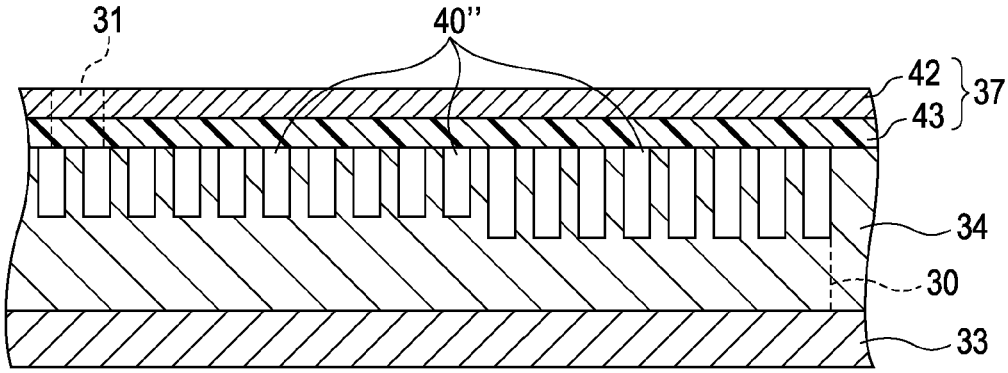
FIG. 5 is a view illustrating a configuration according to a third embodiment of the invention.
Figure 6:
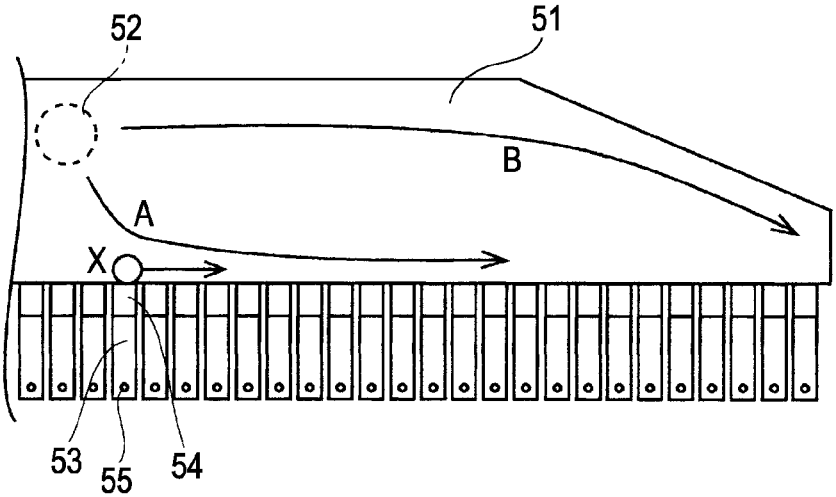
FIG. 6 is a view illustrating a configuration of a common liquid chamber and its surroundings in the related art.

FIG. 5 is a cross-sectional view illustrating discharge openings 40" in a configuration according to a third embodiment. In the embodiment, what is different from the first and second embodiments is that the discharge openings 40" include a plurality of aperture portions arranged along the pressure chamber arrangement direction. Since the other portions in the configuration are the same as in the first embodiment, description of the other portions will be omitted. As shown in FIG. 5, each of the discharge openings 40" is formed of in a rectangular aperture and disposed in a position corresponding to each of the pressure chambers 36. If the plurality of discharge openings 40" are disposed corresponding to the pressure chambers as described above, the discharge openings can have individually different dimensions. This makes it possible to obtain a more desired pressure loss in comparison with the configuration of the second embodiment. Needless to say, the dimensions of each of the discharge openings 40" can be set uniformly.

It is to be noted that the invention can be applied to recording heads having different configurations from the recording head 4 exemplified in the above embodiments in so far as a common liquid chamber which supplies ink to be supplied to a plurality of pressure chambers is included in the configuration. For example, the invention can be applied to a type of recording head in which so-called flexural vibration type piezoelectric devices are disposed individually for the pressure chambers and also to a type of recording head in which an electrical field shear-deforms piezoelectric vibrators. In addition, the invention can be applied to liquid ejecting heads other than an ink ejecting recording head, such as a color material ejecting head used in manufacturing color filters of a liquid crystal display and the like, an electrode material ejecting head used in forming electrodes of an organic EL (Electro Luminescence) display, a surface light emission display (FED) and the like, and a bioorganic compound ejecting head used in manufacturing biochips (biochemical element).

What is claimed is:

1. A liquid ejecting head, comprising:

a liquid passage including a liquid conducting path, a common liquid chamber, a plurality of individual supply paths, a plurality of pressure chambers, and nozzles, wherein liquid from a liquid supply source is supplied to the common liquid chamber through the liquid conducting path, the liquid in the common liquid chamber is distributed to the plurality of pressure chambers through the plurality of individual supply paths, pressure fluctuation is caused in the liquid in the pressure chambers by driving a pressure generation unit, and the liquid is ejected from the nozzles, wherein the liquid passage includes an intermediate liquid chamber that is provided between the liquid conducting path and the common liquid chamber and communicates with the liquid conducting path and the common liquid chamber, and has a conducting opening which communicates with the liquid conducting path and a discharge opening which is opened to the common liquid chamber, wherein a partition wall separates the common liquid chamber and the intermediate liquid chamber and wherein the discharge opening is positioned adjacent the partition wall, and wherein the discharge opening is formed along a pressure chamber arrangement direction.

2. The liquid ejecting head according to claim 1, wherein a pressure loss in the discharge opening is larger than a pressure loss generated in a flow from the conducting path to an edge portion of the intermediate liquid chamber in the pressure chamber arrangement direction.

3. The liquid ejecting head according to claim 1, wherein a pressure loss at an edge portion of the discharge opening in the pressure chamber arrangement direction is smaller than a pressure loss at a center portion of the discharge opening in the pressure chamber arrangement direction.

4. The liquid ejecting head according to claim 1, wherein an edge surface of the common liquid chamber in the pressure chamber arrangement direction and an edge surface of the intermediate liquid chamber in the pressure chamber arrangement direction are flush.

5. The liquid ejecting head according to claim 4, wherein the edge surface of the common liquid chamber in the pressure chamber arrangement direction is in parallel to the individual supply paths.

6. The liquid ejecting head according to claim 1, wherein a bottom surface of the discharge opening and a bottom surface of each of the individual supply paths are flush.

7. The liquid ejecting head according to claim 1, wherein the discharge opening is formed into a slit shape from one edge to the other edge of the common liquid chamber along the pressure chamber arrangement direction.

8. The liquid ejecting head according to claim 1, wherein the discharge opening is formed of a plurality of apertures corresponding to the plurality of pressure chambers along the pressure chamber arrangement direction.

9. A liquid ejecting apparatus, comprising:

the liquid ejecting head according to claim 1.

* * * * *